US009367039B2

(12) United States Patent
Carreno et al.

(10) Patent No.: US 9,367,039 B2
(45) Date of Patent: Jun. 14, 2016

(54) HOROLOGY DEVICE FOR DISPLAYING TIME OR TIME-DERIVED INFORMATION

(71) Applicant: MONTRES TUDOR SA, Geneva (CH)

(72) Inventors: William Carreno, Geneva (CH); Yacine Belkhanfar, Peron (FR)

(73) Assignee: MONTRES TUDOR SA, Geneva (CH)

( * ) Notice: Subject to any disclaimer, the term of this patent is extended or adjusted under 35 U.S.C. 154(b) by 0 days.

(21) Appl. No.: 14/825,269

(22) Filed: Aug. 13, 2015

(65) Prior Publication Data

US 2016/0048107 A1 Feb. 18, 2016

(30) Foreign Application Priority Data

Aug. 14, 2014 (EP) ..... 14180913

(51) Int. Cl.

| | |
|---|---|
| ***G04B 19/04*** | (2006.01) |
| ***G04B 1/00*** | (2006.01) |
| ***G04B 19/24*** | (2006.01) |

(52) U.S. Cl.

CPC ..... *G04B 19/046* (2013.01); *G04B 1/00* (2013.01); *G04B 19/24* (2013.01)

(58) Field of Classification Search

CPC ..... G04B 19/046; G04B 1/00; G04B 19/24; G04B 19/20; G04B 19/25; G04B 19/25366

USPC ..... 368/35, 37

See application file for complete search history.

(56) References Cited

U.S. PATENT DOCUMENTS

| | | | | |
|---|---|---|---|---|
| 4,537,823 | A | 8/1985 | Tsang et al. | |
| 7,102,962 | B2 * | 9/2006 | Suzuki | G04B 19/25366 368/37 |

(Continued)

FOREIGN PATENT DOCUMENTS

| | | | |
|---|---|---|---|
| CH | 310559 | A | 10/1955 |
| EP | 0 142 683 | A2 | 5/1985 |

(Continued)

OTHER PUBLICATIONS

European Search Report and Written Opinion dated Jun. 24, 2015, issued in counterpart application No. PCT/EP14180913.7; w/English partial translation and partial machine translation (12 pages).

*Primary Examiner* — Sean Kayes

(74) *Attorney, Agent, or Firm* — Westerman, Hattori, Daniels & Adrian, LLP

(57) ABSTRACT

A device (100) for displaying time information,
including: (i) a first mobile (3) including a first toothset (31) and a first disk (32) bearing numerals (33) which are intended to indicate the units of the time
information, (ii) a second mobile (4) including a second toothset (41) and a second disk (42) bearing numerals (43) intended to indicate the tenths of the time information,
and (iii) a mechanism (90) for driving the first and second mobiles, the mechanism
including (i) a control mobile (1)
including a third toothset (1*a*) arranged so as to collaborate by obstacle, with the first
toothset, a fourth toothset (1*b*) arranged so as to collaborate by obstacle, with the second
toothset, a drive wheel (2) including a fifth toothset (2*c*) designed to collaborate by obstacle, with the third and fourth toothsets.

20 Claims, 8 Drawing Sheets

(56) References Cited

U.S. PATENT DOCUMENTS

| | | | | |
|---|---|---|---|---|
| 7,110,326 | B2 * | 9/2006 | Besse | G04B 19/25366 368/37 |
| 7,433,272 | B2 * | 10/2008 | Watanabe | G04B 19/24 368/35 |
| 7,457,202 | B2 * | 11/2008 | Takahashi | G04B 19/25333 368/28 |
| 7,706,214 | B2 * | 4/2010 | Scheufele | G04B 19/2536 368/28 |
| 8,811,125 | B2 * | 8/2014 | Schmidt | G04B 19/2536 368/28 |
| 8,842,500 | B2 * | 9/2014 | Schmidt | G04B 19/2536 368/37 |
| 2014/0022872 | A1 * | 1/2014 | Tran | G04B 19/25 368/37 |
| 2014/0301170 | A1 * | 10/2014 | Tran | G04B 19/247 368/37 |

FOREIGN PATENT DOCUMENTS

| | | | |
|---|---|---|---|
| EP | 1 509 819 | A2 | 3/2005 |
| EP | 1 801 667 | A1 | 6/2007 |
| EP | 2 161 631 | A2 | 3/2010 |
| FR | 2 796 732 | A1 | 1/2001 |
| WO | 03/104904 | A2 | 12/2003 |

* cited by examiner

HOROLOGY DEVICE FOR DISPLAYING TIME OR TIME-DERIVED INFORMATION

The invention relates to a device for displaying time or time-derived information, notably to a device for displaying the date. It also relates to a horology movement comprising such a device. It finally relates to a timepiece, notably a wristwatch, comprising such a device or such a movement. The invention relates in particular to a display device or mechanism of "large date" type, which means to say a date display that uses a first disk to indicate the units of the date and a second disk to indicate the tens of the date.

There are numerous embodiments or documents that disclose date display control mobiles staged over three levels. Conventionally, the first level is formed of a first interface wheel which is able to be actuated by a date display device driving mobile or a day-of-the-month driving mobile so as to allow the first interface wheel to rotate by one angular pitch on each change of date. Second and third wheels for the second and third levels of the control mobile are respectively in mesh with the units and tens disks so as to allow them to rotate at the required moment. Alternatively, the second and third wheels of the second and third levels are actuated directly via a driving mobile the structure of which has added complexity for this purpose.

Patent CH310559 describes a control mobile provided with three wheels which are superposed on three distinct levels. A first wheel, formed of thirty-one teeth, is intended to be actuated by a date driving mobile so as to allow the control mobile to rotate by one angular pitch once per day. A second wheel, formed of four teeth, is intended to drive a first pinion which moves as one with the tens disk. A third wheel, formed of thirty teeth, is intended to drive a second pinion which moves as one with the units disk. No information is given as to the profiles of the tooth sets of these wheels. It may be noted that this large date mechanism requires a high number of components that need to be assembled and indexed rigorously in order to allow suitable drive of the display disks. Moreover, such a control mobile, because of the three levels it has, is particularly bulky and therefore difficult to incorporate within a horology movement.

Patent application EP1426836 discloses a control mobile similar to the mobile of the above-mentioned document. One difference stems from the special way in which this control mobile is driven, which is via a crownwheel formed of an annular toothset intended to actuate a thirty-one-tooth first wheel of the first level of the control mobile. This crownwheel, intended to be substituted for a conventional date disk, has a particularly complex geometry.

Document U.S. Pat. No. 7,102,962 describes a large date mechanism the control mobile of which is positioned at the centre of the movement so that it can be driven by a conventional calendar drive mobile. This control mobile is also provided with three wheels which are superposed respectively on three levels, just one of these three wheels being intended to collaborate with the calendar drive mobile. This wheel is likewise provided with thirty-one teeth.

Document EP1801667 discloses a control mobile the wheels of which are configured in such a way as to secure the angular positions of the tens and units disks. This control mobile is likewise made up of three distinct levels and therefore does nothing to simplify the large date mechanism.

Document EP2161631 describes a control mobile provided with two wheels which are superposed on two distinct levels. The first wheel of the first level, in mesh with the units disk, is intended to be actuated by thirty pins of a calendar drive crown. The second wheel of the second level, in mesh with the tens disk, is intended to be actuated by four pins of the calendar drive crown. Such a solution simplifies the operation of the control mobile but entails making the calendar drive mobile more complex by adding additional pins. Moreover, these pins cause the large date mechanism to become thicker.

Document EP1509819 also discloses a simplified control mobile which is staged over two levels. Nevertheless, this construction involves a complex drive crownwheel, as well as an ancillary control pinion.

The known display devices are therefore bulky and/or complicated to produce and to implement.

It is an object of the invention to provide a device for displaying time or time-derived information, notably a device for displaying a date, that is able to overcome the aforementioned disadvantages and improve the display devices known from the prior art. In particular, the invention proposes a device for displaying time or time-derived information that is simple, reliable and of limited bulk, particularly of limited thickness.

A display device according to the invention is defined as a device for displaying time or time-derived information, comprising:

- a first mobile including a first toothset and a first disk bearing numerals intended to indicate the units of the time or time-derived information,
- a second mobile including a second toothset and a second disk bearing numerals intended to indicate the tenths of the time or time-derived information, and
- a mechanism for driving the first and second mobiles, the mechanism comprising:
  - a control mobile comprising:
    - a third toothset arranged so as to collaborate by obstacle, notably by meshing, with the first toothset,
    - a fourth toothset arranged so as to collaborate by obstacle, notably by meshing, with the second toothset, a drive wheel comprising a fifth toothset designed to collaborate by obstacle, notably by meshing, with the third and fourth toothsets, one and the same element of the fifth toothset, notably one and the same surface thereof, particularly one and the same surface extending parallel or substantially parallel to an axis (A2) of rotation of the drive wheel, being arranged in such a way as to collaborate with the third and fourth toothsets.

Various embodiments of the display device are defined as follows:

The display device as above, wherein:

- the third and fourth toothsets are arranged in a first plane (P3) and a second plane (P4) that are parallel and distant or on two levels, notably two planes (P3, P4) or two levels extending at right angles to an axis (A1) of rotation of the control mobile, the first toothset intersecting the first plane (P3) and not the second plane (P4) or extending over a first level only and the second toothset intersecting the second plane (P4) and not the first plane or extending on a second level only, or
- the third and fourth toothsets are arranged in a first plane (P3) and a second plane (P4) which are parallel to and distant from one another or on two levels, notably two planes (P3, P4) or two levels extending at right angles to an axis (A1) of rotation of the control mobile, the first toothset intersecting the first plane and the second plane or extending over both levels and the second toothset intersecting the second plane (P4) and not the first plane (P3) or extending over a second level only.

The display device as above, wherein the third and fourth toothsets are arranged in a first plane (P3) and in a second plane (P4) that are parallel and distant or on two levels, notably two planes (P3, P4) or two levels extending at right angles to an axis (A1) of rotation of the control mobile, the fifth toothset of the drive wheel intersecting the first plane (P3) and the second plane (P4) or the fifth toothset of the drive wheel intersecting the two levels.

The display device as above, wherein the toothsets of the first mobile, of the second mobile, of the control mobile and of the drive wheel are arranged on two levels only.

The display device as above, wherein the element extends over a first level embodied by the first plane (P3) which is for example the mid-plane of the third toothset, and the element also extends over a second level embodied by the second plane (P4) which is, for example, the midplane of the fourth toothset.

Various embodiments of the display device are defined as follows:

The display device as above, wherein the third and fourth toothsets complement one another and together form:

a sixth toothset having thirty-one or thirty teeth and/or a toothset having an angular pitch of one thirty-first of a revolution.

The display device as above, wherein the control mobile is arranged in such a way as to make a thirty-first of a revolution every twenty-four hours.

The display device as above, wherein the control mobile is of one piece or manufactured as one or created by assembly, notably superposition, of two elements respectively having the third and fourth toothsets.

The display device as above, wherein the third and fourth toothsets are external toothsets and/or the fifth toothset is an external toothset.

The display device as above, wherein the first and second disks are arranged on one and the same plane (P1) and/or each have the same number of numerals, notably ten numerals, and/or have the same diameter or substantially the same diameter.

The display device as above, wherein the third toothset comprises thirty teeth, the angular pitch between the teeth being 360°/31 and/or wherein the fourth toothset comprises four teeth or five teeth, the angular pitch between two teeth being a multiple of 360°/31.

The display device as above, wherein an angle ($\alpha$) formed by a semistraight line which has its origin on an axis (A1) of rotation of the control mobile and that passes through an axis (A3) of rotation of the first mobile and by a semistraight line that has its origin on an axis (A1) of rotation of the control mobile and that passes through an axis (A4) of rotation of the second mobile is less than 170°, or even less than 160°.

The display device as above, wherein the drive wheel is secured to a star, notably a seven-tooth or fourteen-tooth star, and/or the drive wheel is situated at the center of a timepiece movement.

The display device as above, wherein the second disk comprises one of the following series of numerals:

"0, 1, 2, 3, 0, 1, 2, 3";

"0, 0, 1, 2, 3, 0, 0, 1, 2, 3";

"0, 1, 1, 2, 3, 0, 1, 1, 2, 3";

"0, 1, 2, 2, 3, 0, 1, 2, 2, 3";

"0, 1, 2, 3, 3, 0, 1, 2, 3, 3".

The display device as above and which comprises a first jumper associated with the first mobile, the first jumper and the first mobile being arranged in such a way as to position the first mobile in the next position before the first mobile has covered half an angular pitch in the direction of increasing indication of the numerals borne by the first disk, and/or a second jumper associated with the second mobile, the second jumper and the second mobile being arranged in such a way as to position the second mobile in the next position before the second mobile has covered half an angular pitch in the direction of increasing indication of the numerals borne by the second disk and/or which comprises a first jumper associated with the first mobile, the first jumper and the first mobile being arranged in such a way as to position the control mobile in the next position after the control mobile has covered half an angular pitch and/or a second jumper associated with the second mobile, the second jumper and the second mobile being arranged in such a way as to position the control mobile in the next angular position after the control mobile has covered half an angular pitch.

The display device as above, wherein the device for displaying time or time-derived information is a device for displaying the date, notably of the "large date" type, the first disk being a units disk and the second disk being a tens disk.

A movement according to the invention is defined as a horology movement comprising a device as above.

A timepiece according to the invention is defined as a timepiece, particularly a wristwatch, comprising a device as above and/or a timepiece movement as above.

The figures by way of example depict two embodiments of a display device according to the invention.

Figure 1:
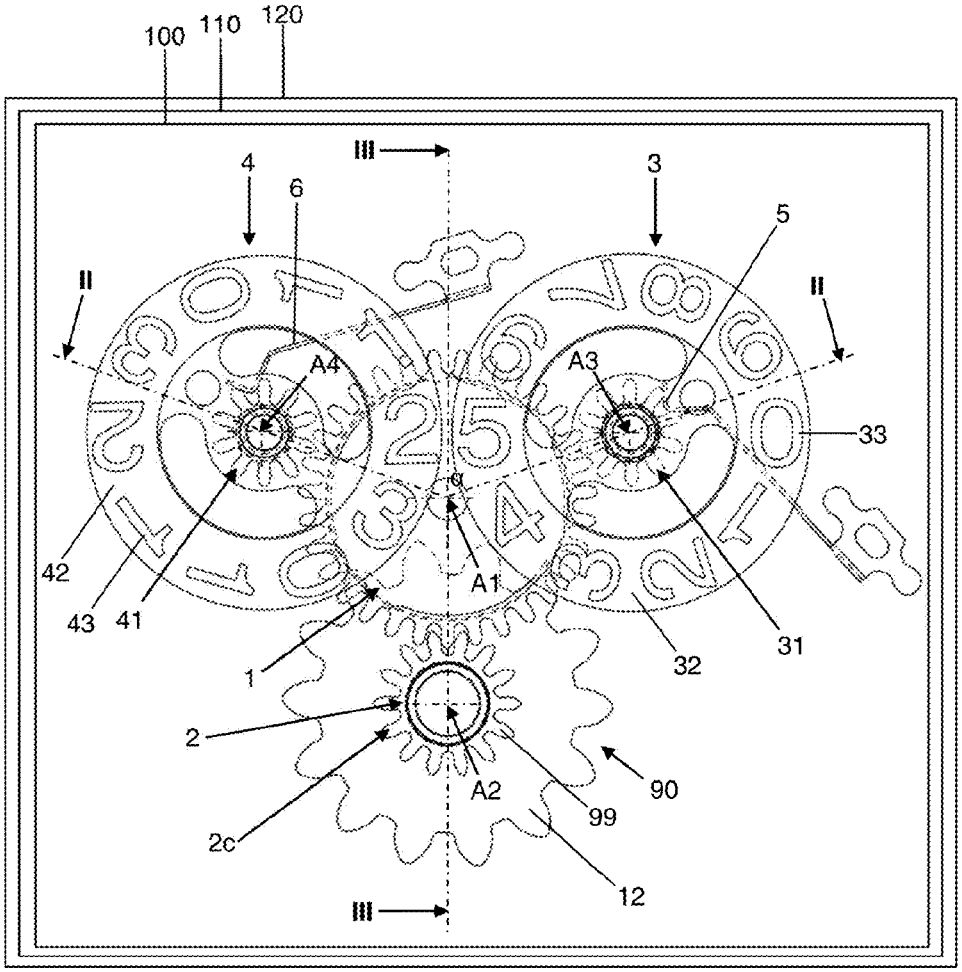
FIGS. 1 to 8 illustrate a first embodiment of a display device according to the invention.
Figure 2:
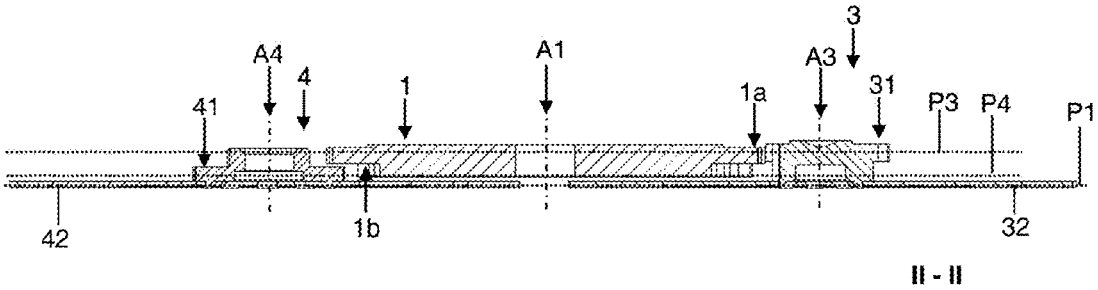
Figure 3:
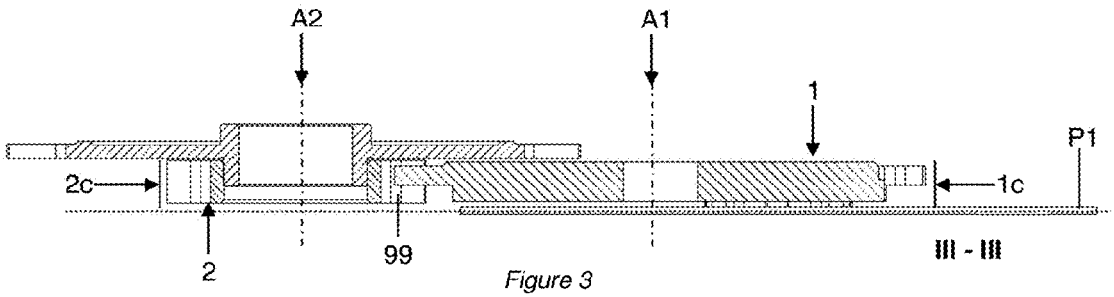

For preference, the invention relates to a device for displaying time or time-derived information, notably a device for displaying information of the "large date" type within which the information is displayed by first and second disks intended respectively to display the tens and the units of the information. It is proposed that use be made of a simplified control mobile for controlling the tens and units disks. The control mobile is arranged and configured in such a way as to rationalize the construction of the device. This furthermore makes it possible to simplify and rationalize the construction of the horology movement in which it is intended to be incorporated. This control mobile also has the advantage of minimizing the thickness required for creating such a device.

A first embodiment of a timepiece 120 according to the invention is described hereinafter with reference to FIGS. 1 to 8. The timepiece is, for example, a watch, notably a wristwatch. The timepiece comprises a first embodiment of a horology movement 110 according to the invention. The horology movement comprises a first embodiment of a device 100 for displaying time or time-derived information according to the invention, notably a device 100 for displaying date information. The display device is of the large date type.

The date display device 100 comprises:

a first mobile 3 including a first toothset 31 and a units disk 32 bearing numerals 33 intended to indicate the date units, a second mobile 4 including a second toothset 41 and a second tens disk 42 bearing numerals 43 intended to indicate the tens of the date; and a mechanism 90 for driving the first and second mobiles.

The drive mechanism comprises:

a control mobile 1 comprising:

a third toothset 1*a* arranged so as to collaborate by obstacle, notably by meshing, with the first toothset 31, a fourth toothset 1*b* arranged so as to collaborate by obstacle, notably by meshing, with the second toothset 41, and a drive wheel 2 comprising a fifth toothset 2*c* designed to collaborate by obstacle, notably by meshing, with the third and fourth toothsets, one and the same element 99 of the fifth toothset, notably one and the same surface 99 thereof, particularly one and the same surface extending parallel or substantially parallel to an axis A2 of rotation of the drive wheel, being arranged in such a way as to collaborate, notably by meshing, with the third and fourth toothsets.

The fifth toothset may have a single tooth.

For preference, the third and fourth toothsets are arranged in two parallel and distant planes P3 and P4 or, in other words, on two levels. The two planes P3 and P4 or the two levels extend perpendicular to an axis A1 of rotation of the control mobile. Thus, the third toothset 1*a* is formed on a first level or on the level of a first plane P3. It is intended to drive the first toothset 31 of a wheel of the first mobile 3. The first toothset 31 moves as one with the units disk 32. For example, the first toothset 31 is fixed to the units disk 32. The fourth toothset 1*b* is formed on a second level or on the level of a second plane P4. It is intended to drive the second toothset 41 of a wheel of the second mobile 4. The second toothset 41 moves as one with the tens disk 42. For example, the second toothset 41 is fixed to the tens disk 42. For preference, the first toothset 31 is situated at the level of the first plane P3 and the second toothset 41 is situated at the level of the second plane P4. In other words, for preference, the first toothset 31 intersects the first plane P3 and not the second plane P4, and the second toothset 41 intersects the second plane P4 and not the first plane P3.

The element 99 may advantageously be a tooth or a tooth surface portion, such as part of a profile forming a tooth. This element 99, notably this tooth surface, extends along the axis A2 so as to collaborate with the third toothset and with the fourth toothset. Thus, the element 99 extends over a first level embodied by the plane P3 which is for example the mid-plane of the third toothset. The element 99 also extends over a second level embodied by the plane P4 which is, for example, the midplane of the fourth toothset.

The third and fourth toothsets may be arranged in a first plane P3 and in a second plane P4 that are parallel and distant or on two levels, notably two planes P3, P4 or two levels extending at right angles to the axis A1 of rotation of the control mobile. It means that the toothset 2*c* of the drive wheel 2 may intersect the first plane P3 and the second plane P4 so that it meshes with the first toothset 31 of the first mobile 3 and with the second toothset 41 of the second mobile 4. Thus, the toothset 2*c* may intersect the two levels of the planes P3 and P4 so that it meshes with the first toothset 31 of the first mobile 3 and with the second toothset 41 of the second mobile 4. Thus, the toothset 2*c* of the drive wheel may be arranged on two levels, particularly on two levels only. The toothsets of the first mobile, of the second mobile, of the control mobile and of the drive wheel may be arranged on two levels only.

Advantageously, teeth of the fourth toothset, particularly the active surfaces of teeth of the fourth toothset, lie in the continuation, along an axis A1 of rotation of the control mobile 1, of teeth of the third toothset, particularly in the continuation, along the axis A1, of active surfaces of teeth of the third toothset. The active surfaces are the surfaces that come into contact upon meshing.

The third and fourth toothsets preferably complement each other and together form:

a sixth toothset 1*c* having thirty-one or thirty teeth, and/or a toothset having an angular pitch of one thirty-first of a revolution.

Thus, the control mobile 1 may comprise a third toothset 1*a* and a fourth toothset 1*b* of which the combination, notably the superposition, allows the formation of a resultant toothset 1*c*. This superposition is advantageously performed along the axis A1. This resultant sixth toothset may be able to be actuated in such a way that the control mobile 1 moves by at least one thirty-first of a revolution every twenty-four hours or covers an angle, measured in degrees, of 360/31 in twenty-four hours. For that purpose, the profiles of the toothsets 1*a* and 1*b* are preferably identical or substantially identical.

The control mobile may thus be arranged in such a way as to perform one thirty-first of a revolution every twenty-four hours.

The control mobile is preferably of one piece or manufactured as one or created by assembly, notably superposition, of two elements respectively having the third and fourth toothsets. For example, the control mobile may be produced by assembling at least two wheels, notably by fixing two wheels together.

For preference, the third and fourth toothsets are external toothsets. The fifth toothset may also be an external toothset.

For preference, the first and second disks 32, 42 are arranged on one and the same plane P1 and/or each have the same number of numerals 33, 43, notably ten numerals, and/or have the same diameter or substantially the same diameter.

In this first embodiment, the tens and units disks each bear ten numerals. For example, the tens disk bears two sets of the series of numerals "0-1-1-2-3", while the units disk indicates a series of numerals "0-1-2-3-4-5-6-7-8-9". Thus, the toothsets 31 and 41 have the same number of teeth, namely ten teeth. As seen earlier, the profiles of the toothsets may be identical or substantially identical.

In the first embodiment, the number of teeth of the third toothset 1*a* of the control mobile 1 differs from that of the resultant sixth toothset 1*c*.

Figure 4:
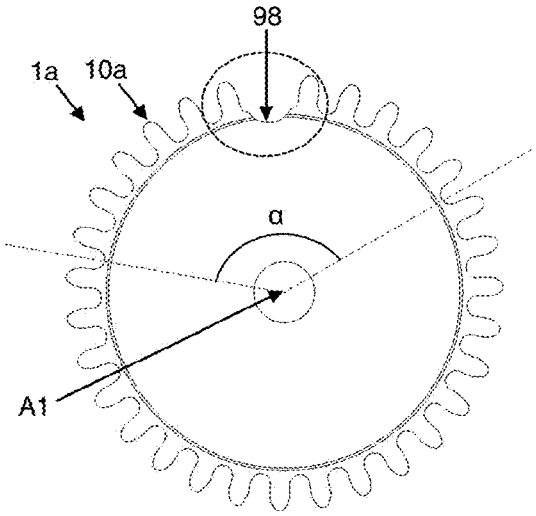

As depicted in FIG. 4, the third toothset 1*a* here comprises thirty teeth 10*a* each of which is intended to drive, once during the month, a first wheel bearing the first toothset 31 by one tenth of a revolution. This first wheel collaborates with a first jumper 5 so as to index the position thereof. The fourth toothset 1*b* here comprises five teeth 10*b* each of which is intended to drive, once in the month, a second wheel bearing the second toothset 41 by one tenth of a revolution. This second wheel collaborates with a second jumper 6 so as to index the position thereof.

The thirty teeth 10*a* and the five teeth 10*b* are arranged in such a way as to generate thirty-one teeth 10*c* on the resultant toothset 1*c*. To do this, the toothsets 1*a* and 1*b* both have an angular pitch of 360°/31, and one tooth 10*b* is superposed in the gap 98 on the third toothset 1*a*. This gap 98 is caused by the absence of a tooth which allows the units disk not to be moved from the thirty-first day of a given month to the first day of the next month. In that way it is possible to pass from the display "31" to the display "01" rather than passing from the display "31" to the display "02" if a tooth were present on the third toothset at the gap 98.

Figure 5:
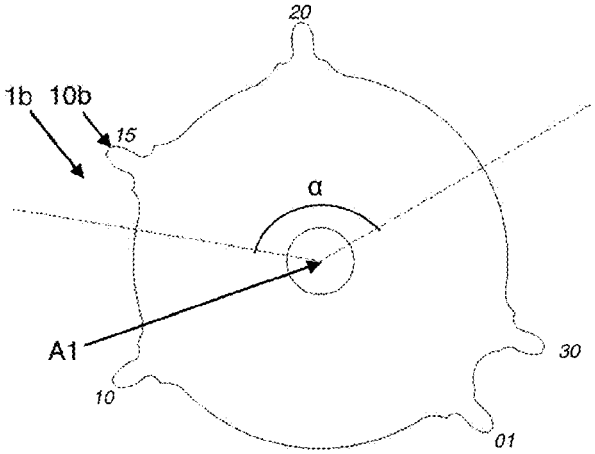
Figure 6:
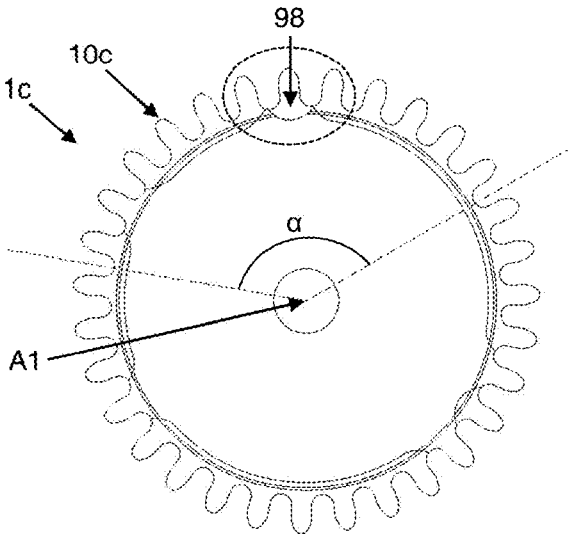

Advantageously, the tooth 10*b* superposed with the gap 98 is intended to allow the tens disk to be driven to a date comprised between the tenth and the twentieth day of the month, for example when passing to the twentieth day of the month as depicted in FIG. 5 which indicates, in italics, for each of the teeth 10*b*, the day of the month on which these teeth act on the tens disk.

The third toothset comprises thirty teeth, the angular pitch between the teeth being 360°/31, namely one thirty-first of a revolution.

The fourth toothset may comprise five teeth or four teeth, the angular pitch between two teeth being a multiple of 360°/31 or of a thirty-first of a revolution.

Figure 11:
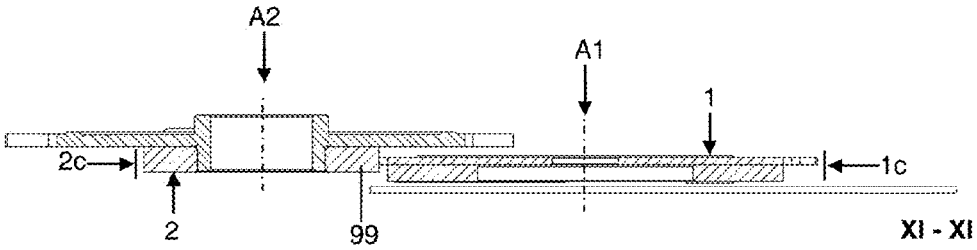
Figure 15:
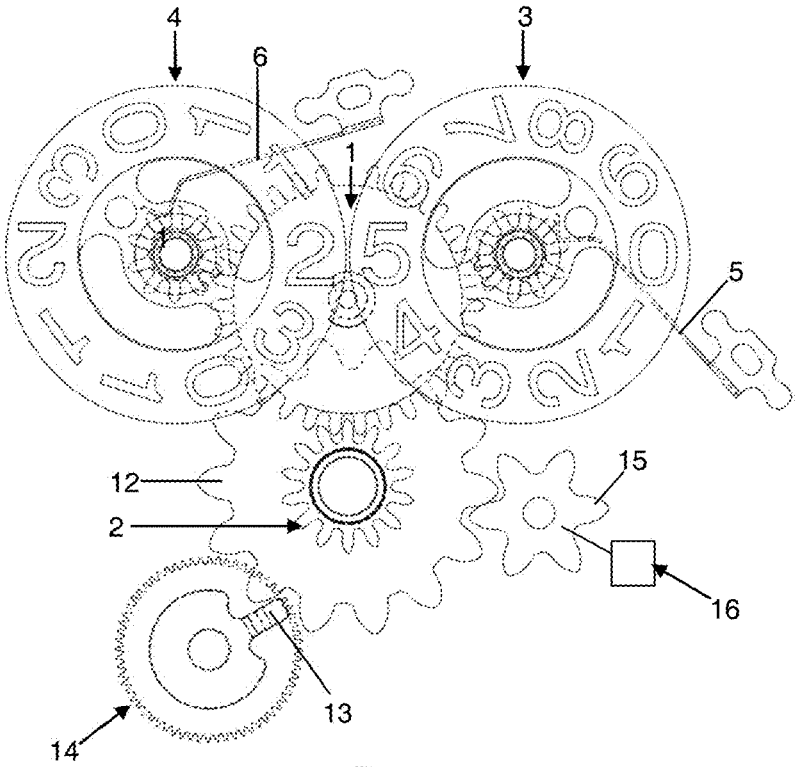
Figure 16:
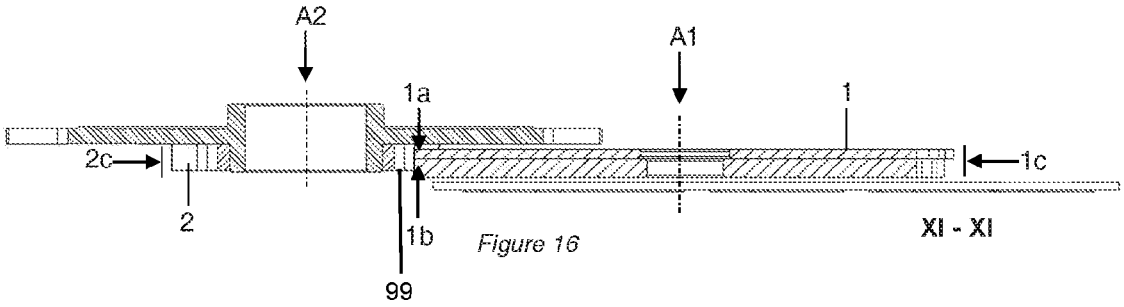

A second embodiment of a timepiece 220 according to the invention is described hereinafter with reference to FIGS. 9 to 16 Note that FIG. 16 corresponds to FIG. 11 except that it shows more distinctly the teeth of the third and fourth toothsets 1*a* and 1*b* intermeshing with element 99. The timepiece is, for example, a watch, notably a wristwatch. The timepiece comprises a second embodiment of a horology movement 210 according to the invention. The horology movement comprises a second embodiment of a display device 200 according to the invention, notably a display device 200 that indicates a date. The display device is of the large date type.

In this second embodiment, any element of the display device that has the same structure and/or the same function as an element of the display device according to the first embodiment bears the same reference as this element of the display device did in the first embodiment.

Figure 12:
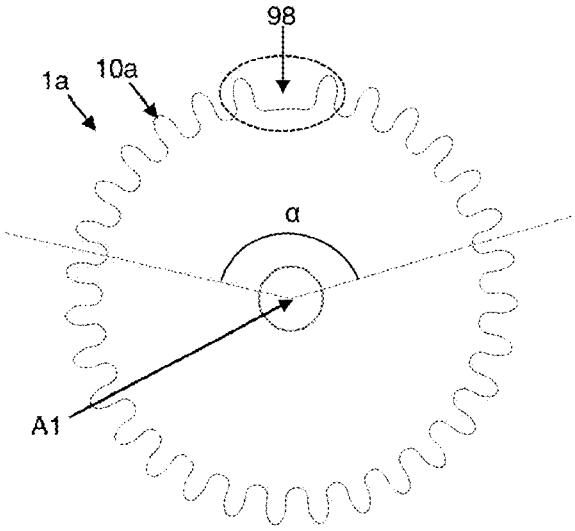
Figure 13:
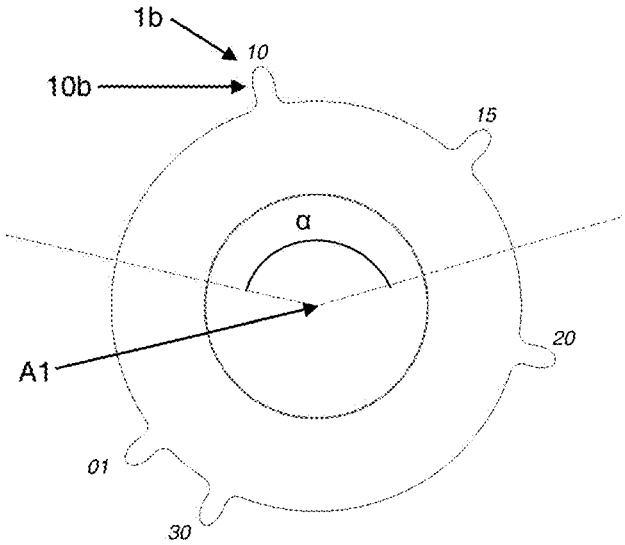
Figure 14:
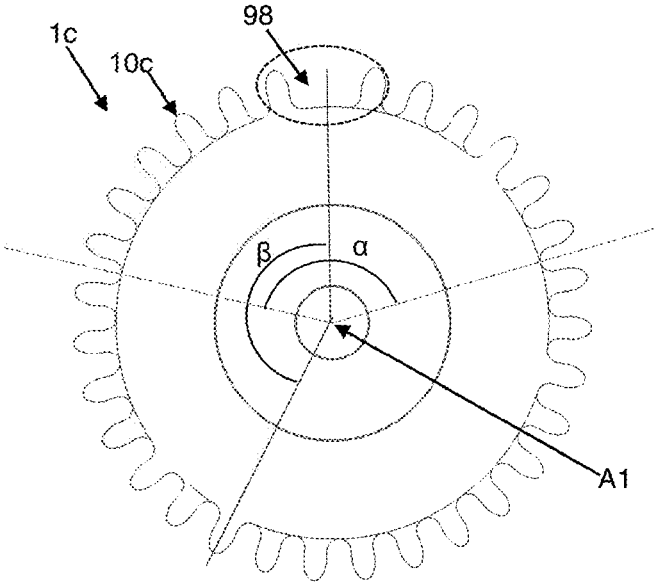

This second embodiment differs from the first embodiment in that the number of teeth of the third toothset 1*a* of the control mobile 1 is equal to that of the resultant sixth toothset 1*c* as depicted in FIGS. 12 to 14.

As in the first embodiment, the third toothset 1*a* may comprise thirty teeth 10*a*. These teeth are each intended to drive, once during the month, the first wheel bearing the first toothset 31 by one tenth of a revolution with the collaboration of a jumper 5. This toothset has an angular pitch of 360°/31 so that a gap allows the units disk not to be moved from the thirty-first day of a given month to the first day of the next month. The fourth toothset 1*b* also has an angular pitch of 360°/31. This fourth toothset may also comprise five teeth 10*b*. These teeth 10*b* are each designed to drive, once during the month, the second wheel 4 bearing the second toothset 41 by one tenth of a revolution with the collaboration of a jumper 6. The sixth toothset 1*c* resulting from the superposition of the third and fourth toothsets 1*a* and 1*b* comprises thirty teeth 10*c*. In other words, the teeth 10*b* are arranged in such a way that none of these teeth is superposed on the gap caused by the absence of a tooth. Thus, the toothset 1*c* has the same overall profile as the toothset 1*a*. In order to allow the control mobile 1 suitable drive, the jumper 5 and/or the jumper 6 are intended to reposition the first and second mobiles angularly. To do that, the jumper 5 and/or the jumper 6 are for example intended to drive the first mobile and/or the second mobile before the first mobile or the second mobile has turned by half a tooth pitch, or even before the first mobile or the second mobile has turned by one third of a tooth pitch. Furthermore, advantageously, the jumper 5 and/or the jumper 6 are intended to reposition the control mobile angularly after the control mobile has covered an angle of a magnitude of the order of half an angular pitch, or even after the control mobile has covered an angle of a magnitude of the order of three-quarters of an angular pitch, under the effect of the drive wheel 2. This for example is achieved by a special shaping of the jumper beak, notably a special geometry of the jumper beak. The geometry of the jumper beak may for that reason be asymmetric, so that the tip of the jumper beak crosses the tip of a toothset tooth before the first mobile or second mobile has turned through half a tooth pitch, or even before the first mobile or the second mobile has turned through one third of a tooth pitch. The repositioning of the control mobile is obtained via the use of suitable clearance between the toothsets 1*c* and 31 and 1*c* and 41, notably between the toothsets 1*a* and 31 and 1*b* and 41.

This second embodiment has the advantage of allowing the first toothset 31 of the first wheel of the first mobile to be arranged over the entire height of the control mobile 1, particularly over the entire height of the sixth toothset 1*c* of the control mobile 1. Thus, this design makes it possible to dispense with the need for axial safety spaces needed in the first embodiment and which, in the first embodiment, are provided in order to make a distinction between a first height of toothset 1*a*, devoted to the driving of the first mobile comprising the units disk, and a second height of toothset 1*b*, devoted to the driving of the second mobile 4 comprising the tens disk. Thus the first toothset 31 may be situated at the levels of the first and second planes P3 and P4, and the second toothset 41 may be situated at the level of the second plane P4. In other words, the first toothset 31 may intersect the first and second planes P3, P4 and the second toothset 41 may intersect the second plane P4 and not the first plane P3. The height of the control mobile 1 can thus be minimized. As a result, the height of the large date display device can also be reduced.

Figure 7:
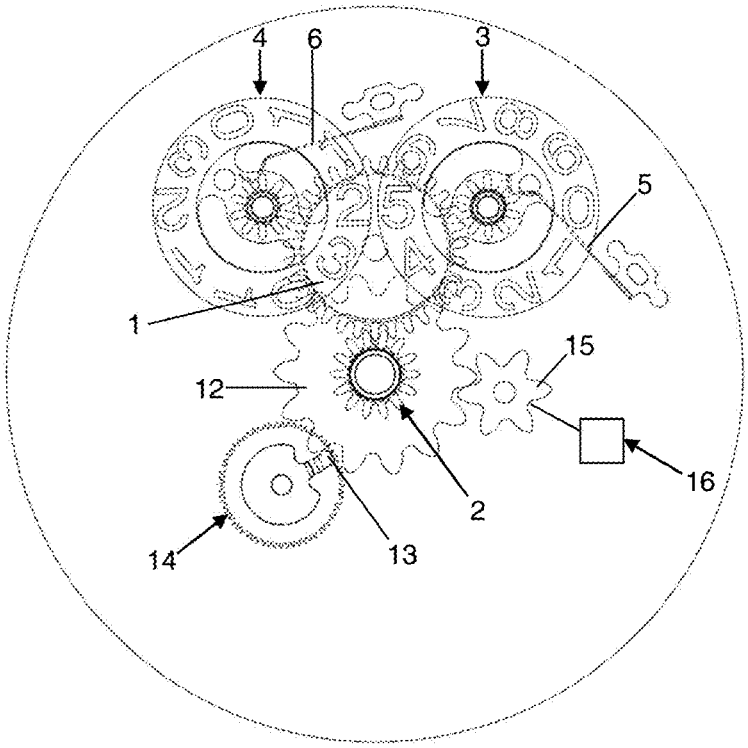

In all the embodiments, the drive wheel may be solid with a star 12. This star may be situated at the centre of the movement. The star is intended to be actuated once a day by a calendar drive finger 13 as depicted in FIGS. 7 and 15. This finger may advantageously be incorporated into a calendar drive device 14 with instantaneous jump. The display of the device may, for its part, be set via a correction star 15 that can be actuated by an ancillary mechanism 16.

In all the embodiments, for preference, the display device may comprise a first jumper 5 associated with the first mobile, the first jumper and the first mobile being arranged in such a way as to position the first mobile in the next position before the first mobile has covered half an angular pitch in the direction of increasing indication of the numerals borne by the first disk. As an alternative or in addition, the display device may comprise a second jumper 6 associated with the second mobile, the second jumper and the second mobile being arranged in such a way as to position the second mobile in the next position before the second mobile has covered half an angular pitch in the direction of increasing indication of the numerals borne by the second disk.

In all the embodiments, for preference, the display device may comprise a jumper 5 and/or a jumper 6 which are intended to reposition the control mobile angularly after the control mobile has covered an angle of a magnitude of the order of half an angular pitch under the effect of the drive wheel 2.

Figure 8:
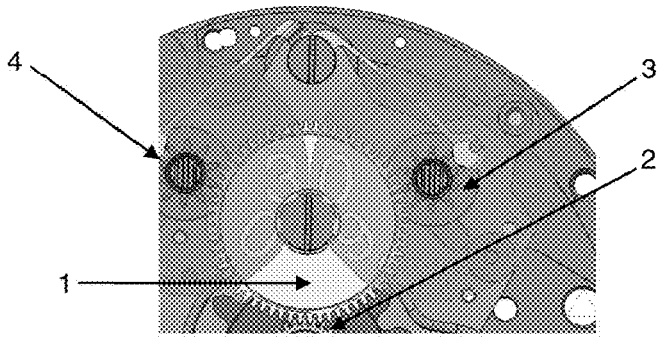
Figure 9:
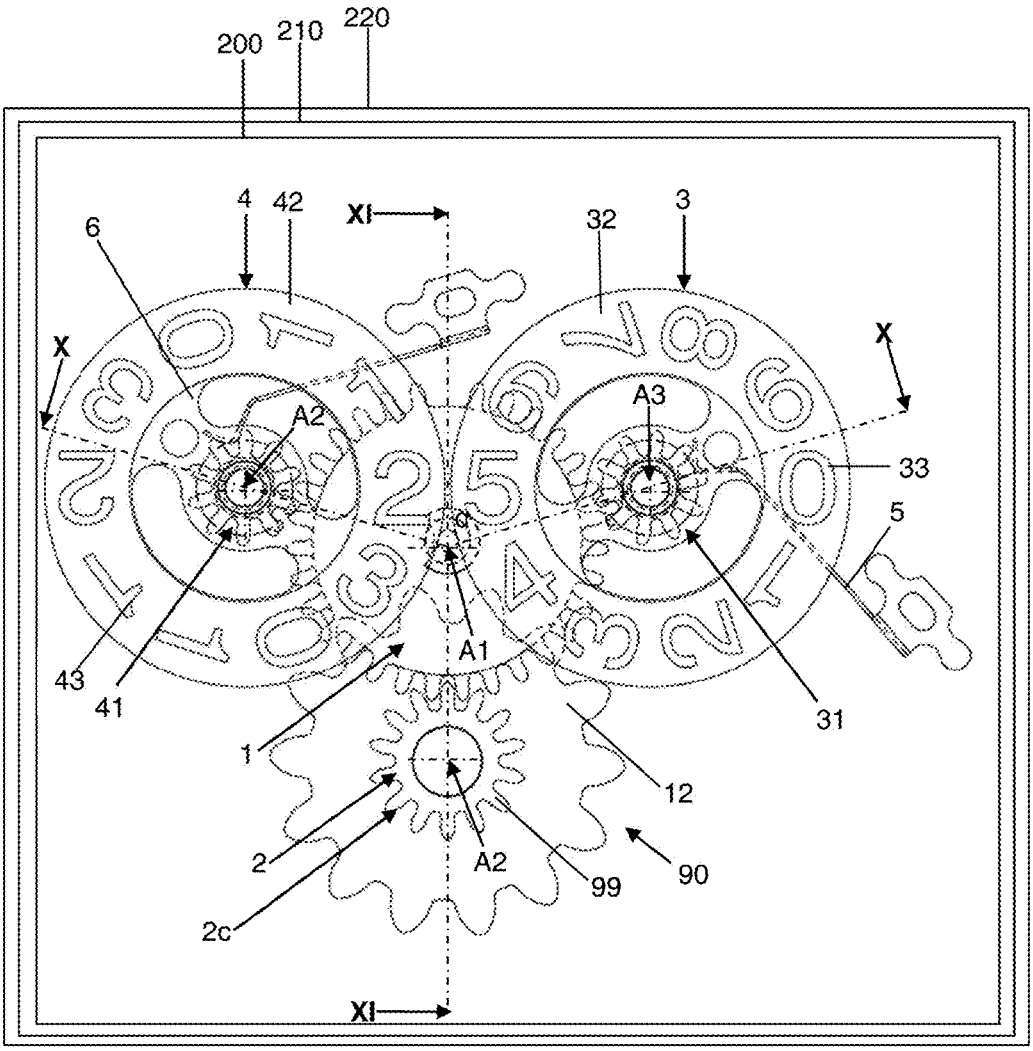
FIGS. 9 to 16 illustrate a second embodiment of a display device according to the invention.
Figure 10:
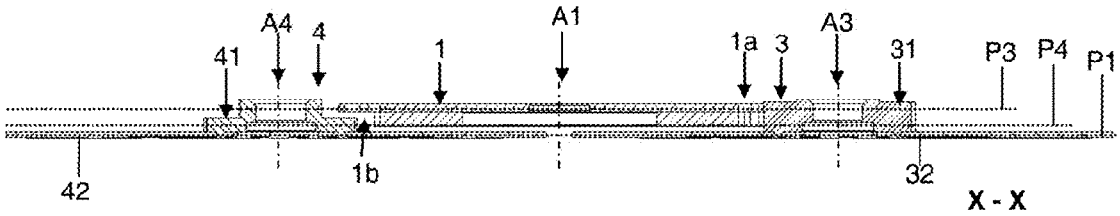

In all the embodiments, the modules of the first, second, third, fourth, fifth, and sixth toothsets are equal or substantially equal and are of the order of 0.2 to 0.3. In an alternative form of embodiment, the module of the third, fourth and sixth toothsets may be lower than that of the first and second toothsets 31 and 41 by approximately a factor of two so as to minimize tooth clearance, as depicted in FIG. 8. In this specific scenario, the third toothset 1*a* comprises sixty consecutive teeth and the fourth toothset 1*b* comprises five sets of two consecutive teeth so as to form a sixth toothset 1*c* provided with sixty-two or sixty teeth. The teeth of the first and second mobiles can then be driven respectively by two consecutive teeth of the control mobile with the collaboration of jumpers 5, 6.

In all the embodiments, an angle $\alpha$ formed by a semistraight line which has its origin on the axis A1 of rotation of the control mobile and that passes through the axis A3 of rotation of the first mobile and by a semistraight line that has its origin on the axis A1 of rotation of the control mobile and that passes through the axis A4 of rotation of the second mobile is advantageously less than 170°, or even less than 160°.

This arrangement allows the tens and units disks to cohabit the same plane close together, while at the same time displaying characters of a font size significantly greater than that of those conventionally displayed by a conventional date disk. Such a configuration is possible because one numeral or digit is duplicated on the tens disk, for example the numeral or digit "1".

In all the embodiments, as depicted in FIG. 14, an angle β formed by a semistraight line having its origin on the axis of rotation A1 of the control mobile 1 and passing through the gap 98 caused by the absence of a tooth, and by a semistraight line having its origin on the axis of rotation of the control mobile 1 and passing through the axis of symmetry of the tooth intended to allow the driving of the tens disk from the twenty-ninth day of the month to the thirtieth day of the month may be equal or substantially equal to the angle α.

In the embodiments, particularly in all the embodiments illustrated, the numeral or digit "1" is preferably duplicated on the tens disk. Alternatively, the digits "0", "2", or "3" could be duplicated by altering the distribution of teeth of the fourth toothset 1*b*.

It is possible for the "0" digits on the tens disk not to be featured. In that case, there may be disk sectors that bear no digit.

The device for displaying time information, notably the device for displaying the day of the month, according to the invention therefore makes it possible to use two disks which are arranged in one and the same plane and have substantially the same diameter. These disks may be solid with wheels preferably provided with the same toothset profile and the same number of teeth, namely ten teeth, which are intended to be actuated by a control mobile comprising a third toothset and a fourth toothset of the same profile the superposition of which allows the creation of a resultant sixth toothset able to be actuated in such a way that the control mobile performs at least one thirty-first of a revolution every twenty-four hours.

Such an arrangement makes it possible to minimize the number of components that make up the control mobile.

The solution also makes it possible to minimize the height of the control mobile. This is formed by at least two levels respectively corresponding to the height of the third toothset and to that of the fourth toothset. Thus, it differs from control mobiles of the prior art which are made up of three levels. Such a construction for example offers the opportunity to add ancillary functions to the control mobile, such as a function of locking at least one of the two display disks.

The control mobile may be in direct engagement with a drive wheel which has a toothset profile identical or substantially identical to the resultant profile of the control mobile.

The device for displaying time information, notably the device for displaying the day of the month, may also be set using correction means common to other display devices such as a display device for indicating the day of the week.

The device for displaying time information, notably the device for displaying the day of the month, may be incorporated into a module intended to be attached to a base movement. This may for example take the place of a module intended to display the day of the week.

In an alternative form compatible with the various embodiments, the second toothset may have a different number of teeth from the first toothset. For example, the second toothset may have eight teeth and the second disk may indicate eight digits (two sets of the series of numerals "0-1-2-3"). In such a scenario, the fourth toothset 1*b* of the control mobile comprises four teeth. These four teeth are each intended to drive, once during the month, the second mobile 41 by one eighth of a revolution with the collaboration of the jumper 6.

In the various embodiments described hereinabove, the display device is a device for displacing the day of the month. Alternatively, the display device according to the invention may for example be intended to indicate time information or time-derived information such as to count minutes of a period timed by an ancillary chronograph mechanism.

Thus, in the same way as was described earlier, a device for displaying the minutes may comprise:

- a first mobile 3 including a first toothset 31 and a units disk 32 bearing numerals 33 which are intended to indicate the units of the minutes,
- a second mobile 4 including a second toothset 41 and a second tens disk 42 bearing numerals 43 intended to indicate the tens of minutes, and
- a mechanism 90 which is capable of driving the first and second mobiles.

For example, the tens disk bears two sets of the series of numerals "0-1-1-2-3", while the units disk indicates a series of numerals "0-1-2-3-4-5-67-8-9". Thus, the toothsets 31 and 41 may have the same number of teeth, namely ten teeth. In that scenario, the display device constitutes a chronograph minutes counter capable of indicating a timed period of thirty minutes or less.

The drive mechanism 90 may comprise a mobile 1 performing one full revolution in thirty minutes. This may comprise a third toothset 1*a* consisting for example of thirty teeth, arranged so as to collaborate by obstacle, notably by meshing, with the first toothset 31, as well as a fourth toothset 1*b*, consisting for example of five teeth, arranged so as to collaborate by obstacle, notably by meshing, with the second toothset 41. The drive mechanism 90 may also comprise a drive wheel 2 performing one complete revolution in one minute. This has a fifth toothset 2*c* which in this instance is reduced to a single tooth which may for example take the form of a minutes drive finger.

The display device according to the invention may of course be intended to indicate any other time or time-derived information, for example calendar information such as an indication of the month or an indication of the minutes over sixty minutes or an indication of the time over twelve or twenty-four hours.

The invention claimed is:

1. A device for displaying time or time-derived information, comprising:

- a first mobile including a first toothset and a first disk bearing numerals intended to indicate the units of the time or time-derived information,
- a second mobile including a second toothset and a second disk bearing numerals intended to indicate the tenths of the time or time-derived information, and
- a mechanism driving the first and second mobiles, the mechanism comprising:
  - a control mobile comprising:
    - a third toothset arranged so as to collaborate by obstacle with the first toothset,
    - a fourth toothset arranged so as to collaborate by obstacle with the second toothset,
  - a drive wheel comprising a fifth toothset designed to collaborate by obstacle with the third and fourth toothsets, one and the same element of the fifth toothset being arranged so as to collaborate with the third and fourth toothsets.

2. The display device as claimed in claim 1, wherein:

the third and fourth toothsets are arranged (i)in a first plane and a second plane, said first plane and said second plane being parallel and distant, or (ii) on two levels, wherein the first toothset intersects the first plane and not the second plane or extends over a first of the two levels only, and the second toothset intersects the second plane and not the first plane or extends on a second of the two levels only, or the third and fourth toothsets are arranged (i)in a first plane and a second plane, said first plane and said second plane being parallel to and distant from one another, or (ii) on two levels, wherein the first toothset intersects the first plane and the second plane or extends over both of the two levels, and the second toothset intersects the second plane and not the first plane or extends over a second of the two levels only.

3. The display device as claimed in claim 1, wherein the third and fourth toothsets are arranged (i) in a first plane and in a second plane, said first plane and said second plane being parallel and distant, or (ii) on two levels, wherein the fifth toothset of the drive wheel intersects the first plane and the second plane, or the fifth toothset of the drive wheel intersects the two levels.

4. The display device as claimed in claim 1, wherein the toothsets of the first mobile, of the second mobile, of the control mobile and of the drive wheel are arranged on two levels only.

5. The display device as claimed in claim 1, wherein the element extends over a first level embodied by the first plane, and the element also extends over a second level embodied by the second plane.

6. The display device as claimed in claim 1, wherein the third and fourth toothsets complement one another and together form at least one of:

a sixth toothset having thirty-one or thirty teeth, and a toothset having an angular pitch of one thirty-first of a revolution.

7. The display device as claimed in claim 1, wherein the control mobile is arranged so as to make a thirty-first of a revolution every twenty-four hours.

8. The display device as claimed in claim 1, wherein the control mobile is at least one of (i) of one piece, (ii) manufactured as one, and (iii) created by assembly of two elements respectively having the third and fourth toothsets.

9. The display device as claimed in claim 1, wherein at least one of (i) the third and fourth toothsets are external toothsets, and (ii) the fifth toothset is an external toothset.

10. The display device as claimed in claim 1, wherein at least one of (i) the first and second disks are arranged on one and the same plane, (ii) the first and second disks each have the same number of numerals, and (iii) the first and second disks have substantially the same diameter.

11. The display device as claimed in claim 1, wherein at least one of (i) the third toothset comprises thirty teeth, the angular pitch between the teeth being 360°/31, and (ii) the fourth toothset comprises four teeth or five teeth, the angular pitch between two teeth being a multiple of 360°/31.

12. The display device as claimed in claim 1, wherein an angle formed by (i) a first semistraight line having an origin on an axis of rotation of the control mobile and passing through an axis of rotation of the first mobile, and (ii) a second semistraight line having an origin on the axis of rotation of the control mobile and passing through an axis of rotation of the second mobile, is less than 170°.

13. The display device as claimed in claim 1, wherein at least one of (i) the drive wheel is secured to a star, and (ii) the drive wheel is situated at the center of a timepiece movement.

14. The display device as claimed in claim 1, wherein the second disk comprises one of the following series of numerals:

"0, 1, 2, 3, 0, 1, 2, 3";
"0, 0, 1, 2, 3, 0, 0, 1, 2, 3";
"0, 1, 1, 2, 3, 0, 1, 1, 2, 3";
"0, 1, 2, 2, 3, 0, 1, 2, 2, 3";
"0, 1, 2, 3, 3, 0, 1, 2, 3, 3".

15. The display device as claimed in claim 1, comprising at least one of:

(i) a first jumper associated with the first mobile, the first jumper and the first mobile being arranged so as to position the first mobile in a next position before the first mobile has covered half an angular pitch in a direction of increasing indication of the numerals borne by the first disk, (ii) a second jumper associated with the second mobile, the second jumper and the second mobile being arranged so as to position the second mobile in a next position before the second mobile has covered half an angular pitch in a direction of increasing indication of the numerals borne by the second disk, (iii) a first jumper associated with the first mobile, the first jumper and the first mobile being arranged so as to position the control mobile in a next position after the control mobile has covered half an angular pitch, and (iv) a second jumper associated with the second mobile, the second jumper and the second mobile being arranged so as to position the control mobile in a next angular position after the control mobile has covered half an angular pitch.

16. The display device as claimed in claim 1, wherein the device for displaying time or time-derived information is a device for displaying the date, the first disk being a units disk and the second disk being a tens disk.

17. A horology movement comprising a device as claimed in claim 1.

18. A timepiece comprising a timepiece movement as claimed in claim 17.

19. The display device as claimed in claim 1, wherein the third toothset is arranged so as to collaborate by meshing with the first toothset, the fourth toothset is arranged so as to collaborate by meshing with the second toothset, and the fifth toothset is designed to collaborate by meshing with the third and fourth toothsets.

20. The display device as claimed in claim 1, wherein one and the same surface of the element of the fifth toothset, said one and the same surface extending parallel or substantially parallel to an axis of rotation of the drive wheel, is arranged so as to collaborate with the third and fourth toothsets.

* * * * *